US011325757B2

(12) United States Patent
Selina et al.

(10) Patent No.: US 11,325,757 B2
(45) Date of Patent: May 10, 2022

(54) CONTAINER CLOSURE FOR POURABLE LIQUIDS INCLUDING A POUR SPOUT AND A TAMPER EVIDENT VENT STRUCTURE

(71) Applicant: Letica Corporation, Rochester Hills, MI (US)

(72) Inventors: John R. Selina, Brighton, MI (US); Wayne J. Harper, Rochester, MI (US); Eric D. Kowal, Macomb, MI (US)

(73) Assignee: Letica Corporation, Rochester Hills, MI (US)

( * ) Notice: Subject to any disclaimer, the term of this patent is extended or adjusted under 35 U.S.C. 154(b) by 666 days.

(21) Appl. No.: 15/848,650

(22) Filed: Dec. 20, 2017

(65) Prior Publication Data

US 2019/0185229 A1 Jun. 20, 2019

(51) Int. Cl.

| | |
|---|---|
| ***B65D 51/16*** | (2006.01) |
| ***B65D 47/06*** | (2006.01) |
| ***B65D 25/44*** | (2006.01) |
| *B65D 25/32* | (2006.01) |

(52) U.S. Cl.

CPC ..... *B65D 51/1672* (2013.01); *B65D 25/44* (2013.01); *B65D 47/063* (2013.01); *B65D 51/1677* (2013.01); *B65D 51/1683* (2013.01); *B65D 25/32* (2013.01); *B65D 2401/15* (2020.05); *B65D 2543/00092* (2013.01); *B65D 2543/00296* (2013.01)

(58) Field of Classification Search

CPC ..... B65D 51/1672; B65D 51/1683; B65D 51/1677; B65D 25/44; B65D 25/32; B65D 47/063; B65D 2401/15; B65D 79/005; B65D 2543/00092; B65D 2543/00296; B65D 39/08; B65D 39/082; B65D 39/084; B65D 39/086; B65D 39/088; B65D 39/10

USPC ..... 220/271, 288, 303

See application file for complete search history.

(56) References Cited

U.S. PATENT DOCUMENTS

| | | | | | |
|---|---|---|---|---|---|
| 1,737,643 | A * | 12/1929 | Conner | B65D 83/0454 | 206/533 |
| 2,971,681 | A * | 2/1961 | Galbierz | B65D 47/265 | 222/548 |
| 4,077,538 | A * | 3/1978 | Waterbury | B65D 17/506 | 220/268 |
| 4,489,864 | A * | 12/1984 | Davis | B65D 47/265 | 220/253 |
| 5,346,106 | A | 9/1994 | Ring | | |
| 5,472,121 | A | 12/1995 | Silano | | |
| 5,893,489 | A | 4/1999 | Giarrante | | |
| 5,955,127 | A | 9/1999 | Glaser | | |
| 6,194,011 | B1 | 2/2001 | Glaser | | |
| 6,626,314 | B1 * | 9/2003 | McHenry | B65D 47/265 | 220/254.2 |
| 7,975,883 | B2 | 7/2011 | Laib et al. | | |
| 9,533,796 | B2 | 1/2017 | Selina et al. | | |
| 10,351,311 | B2 * | 7/2019 | Liu | B65D 43/0218 | |
| 2012/0085793 | A1 * | 4/2012 | Selina | B65D 25/44 | 222/529 |
| 2015/0305984 | A1 * | 10/2015 | Ali | A61J 1/1412 | 116/308 |

* cited by examiner

*Primary Examiner* — Andrew D Perreault

(74) *Attorney, Agent, or Firm* — Barnes & Thornburg LLP

(57) ABSTRACT

A re-closable vent for a container closure which requires no pre-formed holes in the closure deck, provides a tamper-evident feature, and provides simple rotation of a cap structure to open and a vent after punching out a frangible deck section.

20 Claims, 5 Drawing Sheets

CONTAINER CLOSURE FOR POURABLE LIQUIDS INCLUDING A POUR SPOUT AND A TAMPER EVIDENT VENT STRUCTURE

FIELD OF THE INVENTION

This document describes a closure for a container of pourable liquid wherein the closure includes a manually operable vent which, prior to being put into service by the user, requires no holes in the closure deck. Putting the vent into service involves punching out a well-defined frangible area in the deck surface, thereby providing evidence of tampering if done prior to intended use. The vent can be closed by rotating a circular cover having a detent position locator.

BACKGROUND OF THE INVENTION

It is well understood that pouring liquids from unvented containers through spouts can result in a "glug" reaction whereby air is ingested into the container to replace the volume previously occupied by the liquid being poured. To eliminate the "glug" reaction, vents have been provided in various ways. One such vent structure involves the use of a removable plug that fits into a pre-formed hole in the closure deck and is removed by the user when ready to pour liquid from the container. Another vent is disclosed in the U.S. Pat. No. 5,893,489 to Giarrante wherein a vent cap includes a bearing pin fitted into a pre-formed hole in the deck of the container closure to allow rotation of the cap. Another preformed hole provides the vent function when the cap is rotated to an "open" position. We have found that vent structures that require pre-formed holes in the closure deck tend to compromise the integrity of the container and its contents and often result in the inadvertent loss or leakage of liquid from containers during, for example, shipment. Moreover, they do not provide a tamper-evident function.

SUMMARY OF THE INVENTION

We provide a manually operable vent structure for a closure for a container of pourable liquids which vent structure provides an anti-glug feature but does not compromise the integrity of the closure by requiring the formation of holes in the closure deck. In addition, we provide a tamper-evident feature that tells the end user if the container has been opened prior to planned use.

According to our invention, a molded-in vent location in the closure deck has a recessed punch-out area with a partial frangible border. The vent further includes a rotatable vent cap that snaps into a molded retainer/rotation bearing in the deck. A radially offset hole in the cap can be aligned with the punch-out area to open the vent, after the punch-out section is partially removed. The hole in the cap is aligned with the punch-out area initially for the purpose of allowing the punch-out area to be partially separated from the deck without falling into the container or into the liquid stored therein, while at the same time fully opening a hole in the vent deck. The cover or cap can thereafter be rotated to an angular position wherein a detent structure protrudingly formed in the bottom surface of the cap fits into the recessed knock-out vent hole to provide a resilient detent force tending to hold the cap in a fully closed and sealed position.

For ease of operation we provide a raised diametric rib on the cap which is easily grasped and manipulated by the user's fingers.

All of the above is provided in a fully imperforate deck structure which is to say that neither the mounting of the cap, nor the definition of the vent area prior to the punch-out operation involves the formation of a hole in the deck structure. Thus, the integrity of the contents of the container is fully preserved against leakage from the vent prior to opening the vent and partially separating the knock-out area. At the same time, a tamper-evident feature is provided by the frangible punch-out vent location.

All of the features and advantages described above as well other features and advantages hereinafter described will be apparent from the following description which is to be taken with accompanying drawings hereinafter briefly described.

The drawings are to scale.

DETAILED DESCRIPTION OF THE ILLUSTRATIVE EMBODIMENT

Figure 1:
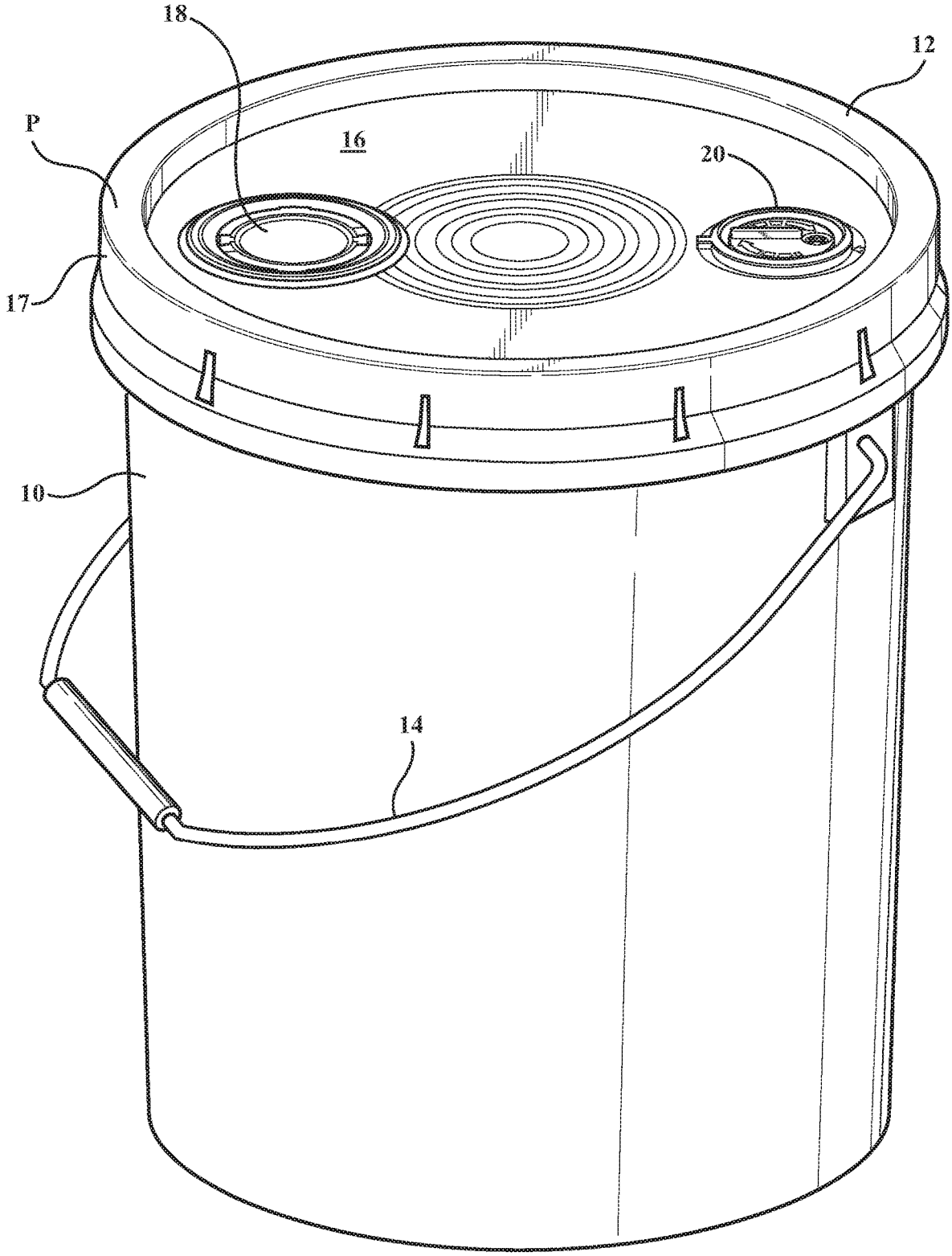
FIG. 1 is a perspective view of a molded plastic container/closure combination wherein the closure is provided with a pull-up spout and a manually operable vent structure having a tamper evident feature.

Referring now to FIG. 1 shows an injection molded high-density polyethylene (HDPE) industrial container 10 having a lock-on closure 12 also of injection molded HDPE secured to the open top thereof. The container may, for example, be of a capacity anywhere between 1 and 6 gallons and is provided with a bale 14 for handling. Such containers are manufactured in large numbers by Letica Corporation of Rochester Mich. and are used to ship and store a variety of materials including but not limited to driveway sealant, wallboard spackling, paint and food products as well as oil and other liquids.

In accordance with the invention described herein the closure 12 is provided with a peripheral structure P including a skirt 17 which "locks" onto the rim of the container 10 in a known fashion. The closure further includes a generally flat center deck 16 which in this instance is provided with a pull-up pour spout 18 and a vent structure 20 providing an anti-glug function as well as a tamper evident function as hereinafter described in detail.

The spout 18 may be of the type described in U.S. Pat. No. 9,533,796 B2 issued Jan. 3, 2017 to John R. Selina and Randall J. Corbett both of whom have assigned their interests in the patent to Letica Corporation. The full disclosure of the aforesaid Selina/Corbett patent is incorporated hereby reference as if set forth in full. Other spout structures can also be used.

Figure 2:
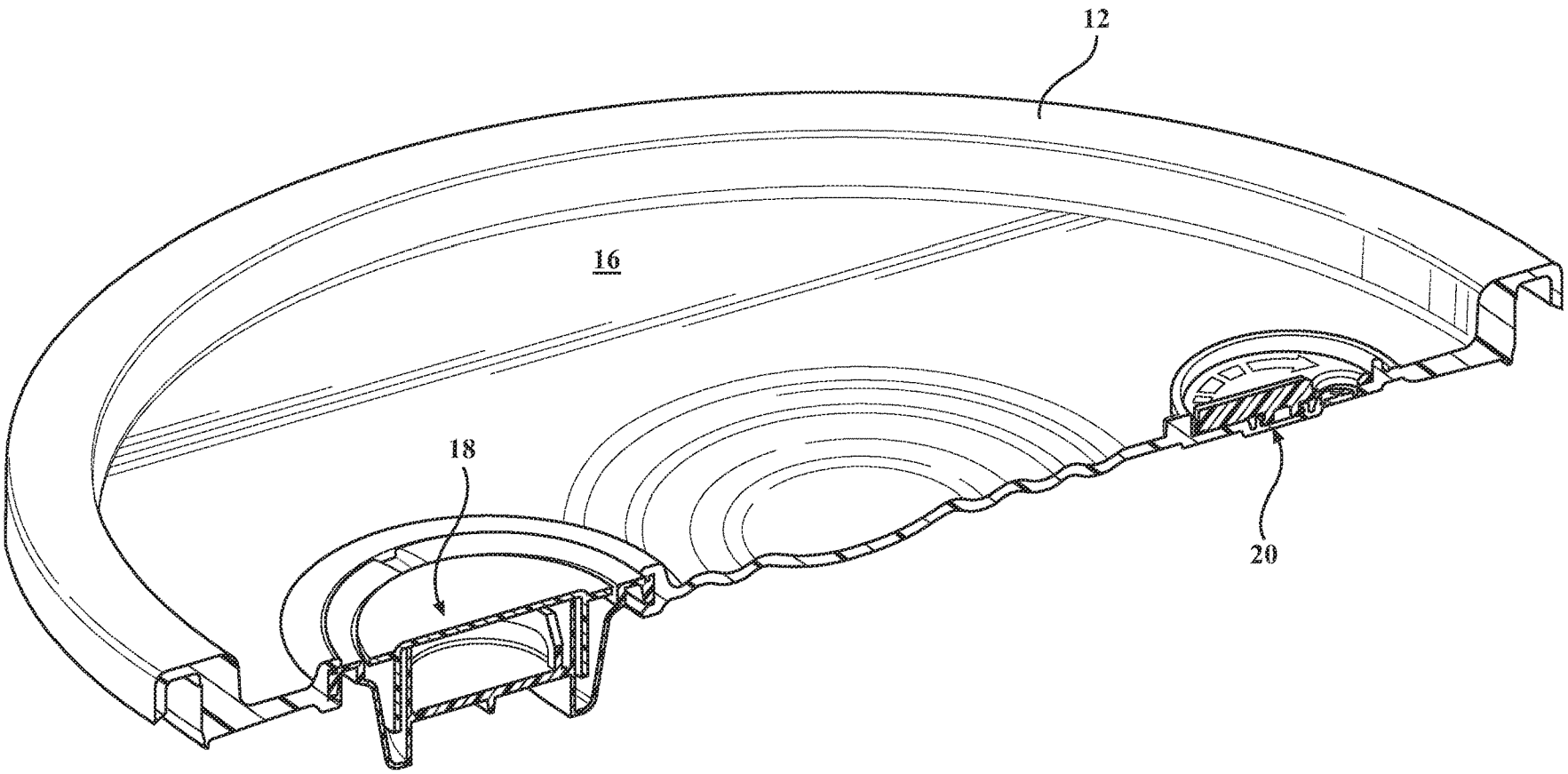
FIG. 2 is a perspective view along a section line through the closure of FIG. 1 wherein the section is taken through the center of the pull-up spout and the vent.
Figure 3:
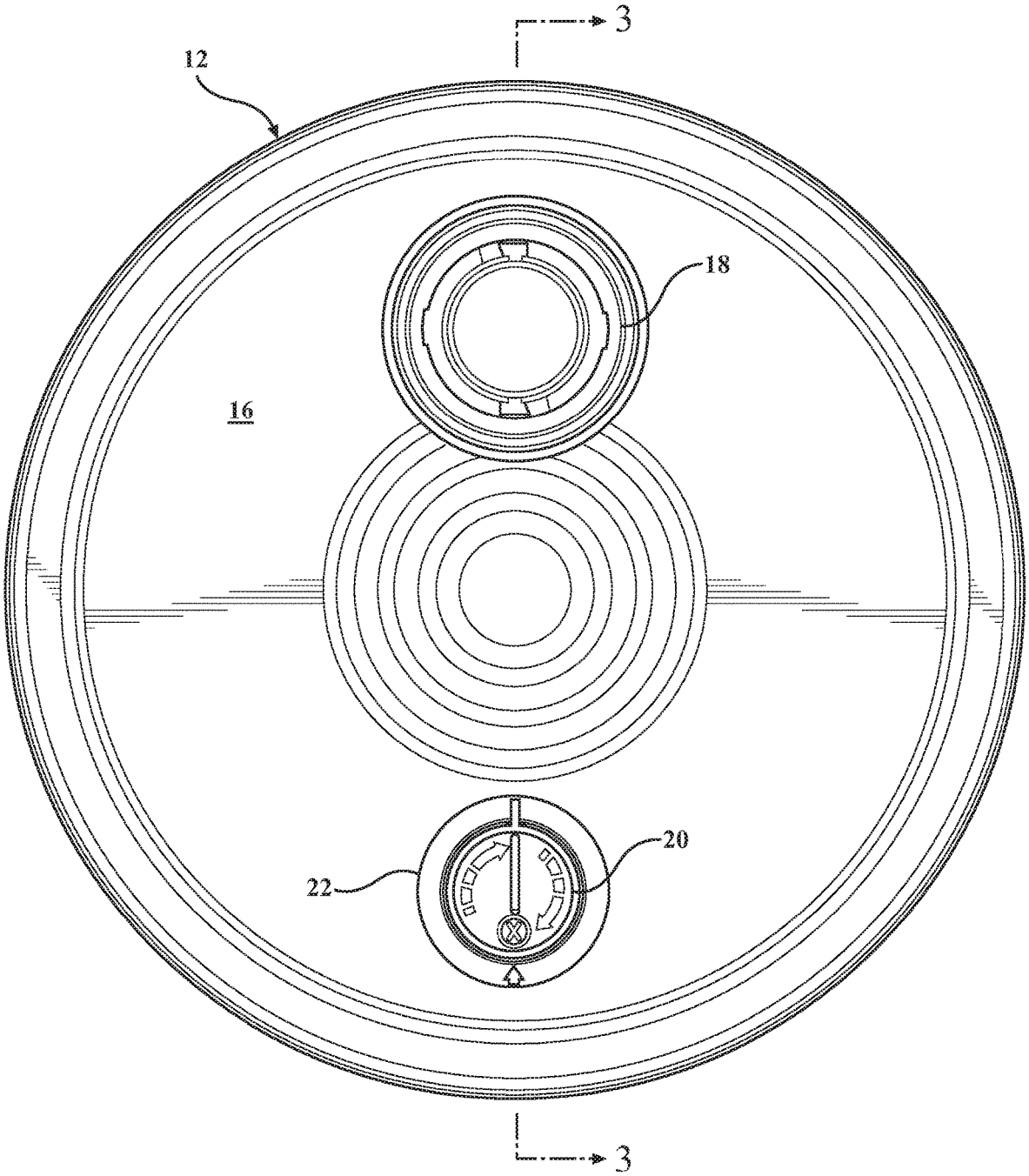
FIG. 3 is a top plan view of the closure shown in FIG. 1.
Figure 4:
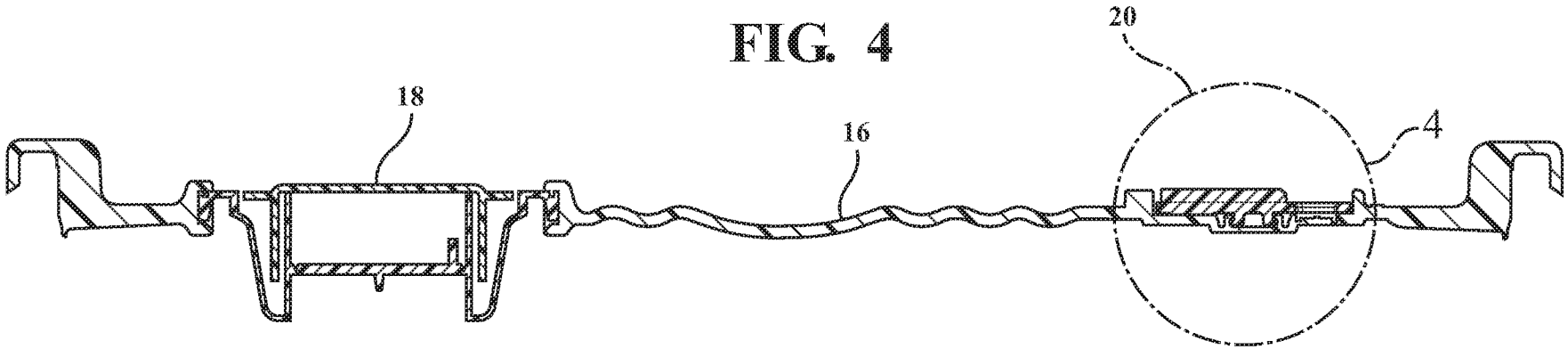
FIG. 4 is a further sectional view through the closure and diametrically through the spout and the vent area.

Referring now to FIGS. 2-7 the details of the structure will be described with emphasis on the structure and function of the vent 20 in the deck 16 of the closure 12. As shown in FIGS. 2 and 3, the pour spout 18 and the vent structure 20 are arranged along a diameter co-extensive with the section line 3-3 in the circular closure 12. Moreover, the spout 18 and vent 20 are on opposite sides of the center of the deck 16, an arrangement which works best using the spout 18 to pour liquid such as oil or other stored liquid from the container during use.

As hereinafter described in greater detail the vent structure can be opened and closed according to the wishes of the end user, must be "activated" or put into service by a punch-out operation hereinafter described and, as a result of the punch-out feature, provides tamper evidence as will be apparent from the following description.

Referring now to particularly FIGS. 4-7 the vent structure 20 is shown to comprise a raised circular rim 22 which is integrally molded into the deck 16 of the closure 12 approximately 2" to 2½" in diameter, a circular recess 24 is formed within the rim 22 and a circular segmented retainer structure 26 with an undercut is adapted to receive a bearing 36 on the bottom surface of the circular vent cover 34 as better described with reference to FIGS. 6 and 7. The bearing 36 is also undercut and sized to snap into the retainer 26. Accordingly, the cover 34 maybe snapped in to the undercut feature provided by the retainer 26 and held firmly in place without the need for forming any holes in the deck structure which could compromise the integrity of closure and the contents of the container 10. The fit between retainer 26 and bearing 36 allows the cover 34 to be rotated by hand pressure to open and close the vent as hereafter described.

Offset from the center of the recess 24 is a molded in area 28 having a partially circular border area 30 which is deep enough to provide a frangible operation whereby approximately 80% to 90% of the circular area 28 can be punched-out with the use of a screwdriver, punch or other tool. However, the recessed groove 30 only extents about 80% to 90% of the way around the punch-out area 28 as shown by the less deep grooved area 32 which acts as a hinge to prevent the plug area 28 from falling into the container contents after it is activated by the user as described above.

Figure 5:
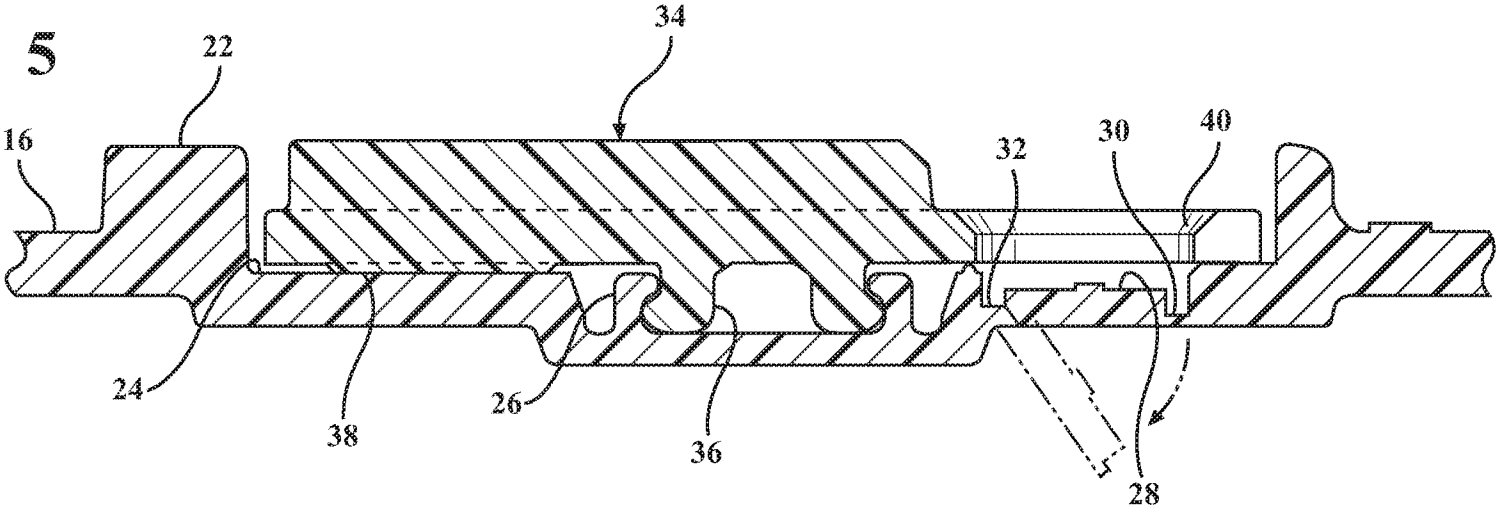
FIG. 5 is a sectional view on an enlarged scale of the structure within the circle marked by the number "4" in FIG. 4.

The rotatable vent cover is molded to provide a raised grip 44 to facilitate rotation thereof between a first position in which a circular detent plug 38 on the bottom of cover 34 fits into the area around and over the knock-out plug area 28 to seal the vent hole which is provided by knocking the plug out as shown by the phantom line in FIG. 5. The detent 38 also provides a locator function which tells the user that the cover 34 is in the vent closed position and also helps hold it in that position. Cap position is also indented by means of a feature 46 which is molded into the side of the circular rim 22 around the vent area, i.e., the rib 44 aligns with the feature 46 when the vent is open.

Figure 6:
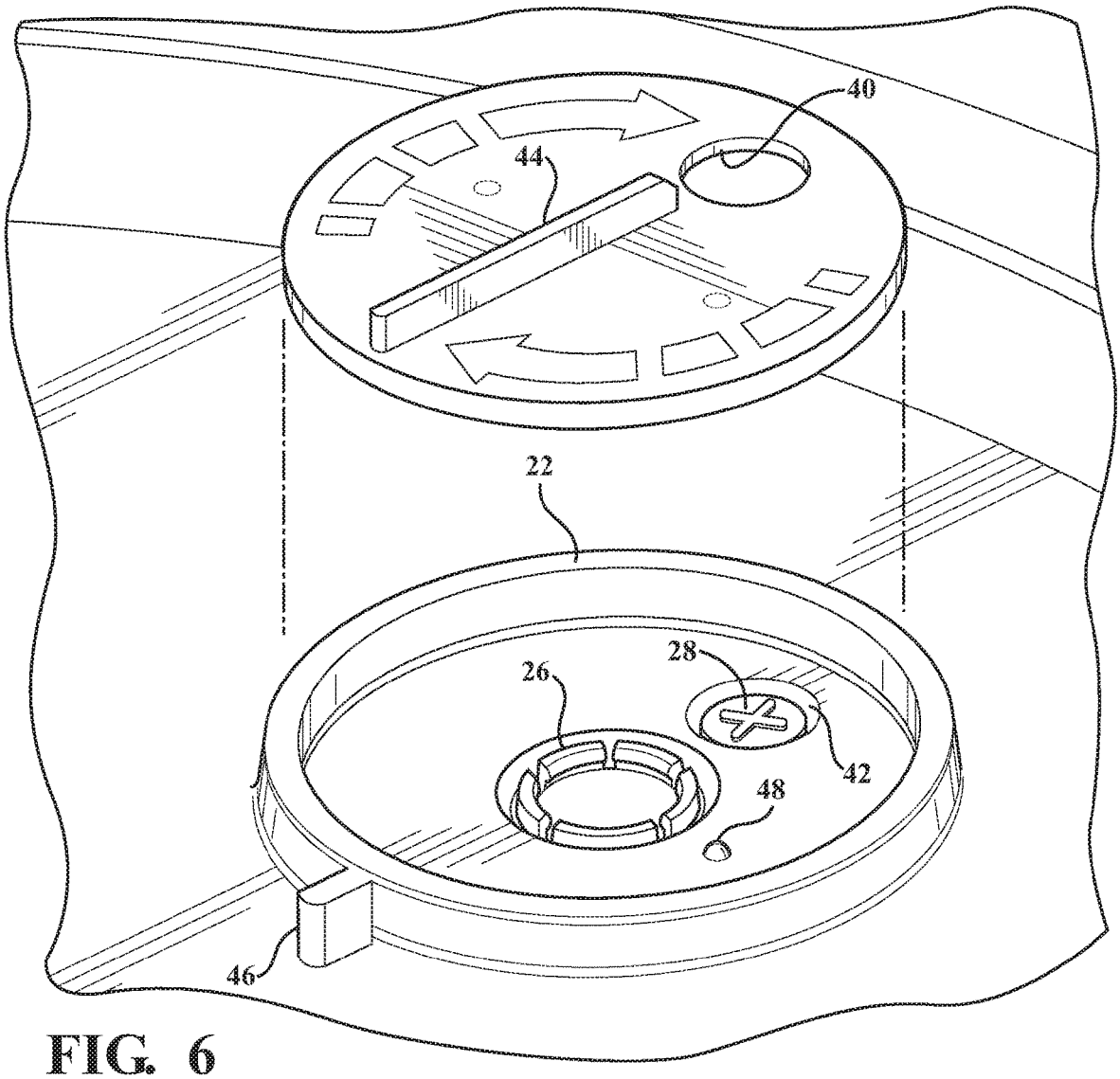
FIG. 6 is a perspective view in detail of the vent structure.

A hole 40 is formed in the cap as best shown in FIGS. 5 and 6 and is approximately the same diameter as the plug area 28 and the surrounding hole 42 in the vent area within the rim structure 22.

Figure 7:
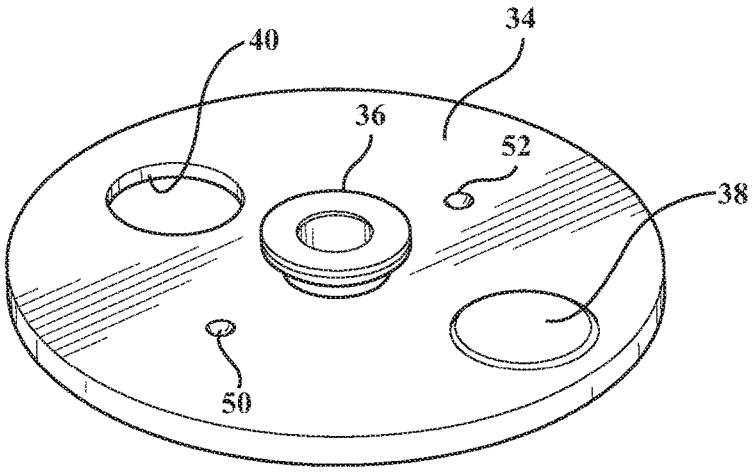
FIG. 7 is a perspective view of the bottom of the vent cover illustrating the detent structures as well as the center bearing that provides rotation of the cover during operation.

As shown in FIGS. 6 and 7 a secondary detent 48 is formed in the surface of the deck within the vent rim 22 and this detent cooperates with holes 50 and 52 on the bottom of the cover 34 to further hold the cap in the open and closed positions which in this case are 180° apart. The bearing 36 which fits into the segmented snap in retainer structure 26 is also illustrated in FIG. 7.

In operation, the closure is injection molded of HDPE material and the spout structure 18 is installed in accordance with the teachings in the aforementioned U.S. Pat. No. 9,533,796. That spout is installed in a flush condition with deck 16 for shipment but can be activated manually by pulling up on a handle structure surrounding the spout and opened to permit the contents of the container to be poured out. Also in the molding of the closure combination the deck structure 16 is completely imperforate in the area of the vent; i.e., there are no holes pre-formed in the deck structure to provide either the vent opening or to provide for the joining of the rotatable cover 34 to the vent area for later operation. Instead, the closure is molded so as to have the retainer 26 and a punch-out vent hole area, both of which are integral with deck 16. The vent cover 34 is snapped into place by inserting the bearing 36 into the retainer undercut 26 and the cap or cover 34 is rotated to the closed position which maybe indicated by molded in indicia in the top of the cap as shown in FIG. 6.

When it comes time to use the spout to pour liquid from the container, the cover 34 is rotated to the open position wherein the hole 40 is aligned with the knock-out plug area 28. A punch or screwdriver or other suitable tool is used to partially separate the frangible plug 28 from the surrounding deck area, the hinge 32 operating to prevent the entirety of the plug from falling into the liquid within the container while at the same time fully opening the vent hole. Because the cap has already been placed in the open position, the vent is now fully operable and liquid may be poured from the container 10 with no "glug" reaction.

When the pouring function is finished the cover 34 is rotated back to the closed condition wherein the detent plug 38 fits into the vent hole 42 immediately above the plug area so as to provide a primary detent function along with the secondary detent function provided by the nib 48 and one of the holes 50, 52. In this position the vent is fully closed and sealed but is easily reopened for further and additional pouring operations. Moreover, the grip rib 44 no longer reaches to the external feature 46, telling the user the vent is closed.

It is all be understood that the invention has been described with respect to a specific and illustrative embodiment thereof and that various aspects including dimensions and other configurations are subject to modification without loss of the overall intended functions of providing a tamper evident feature, a vent structure requiring no holes or perforations in the deck lid in the area of the vent and which provides simple operation both to open the vent for pouring and reclosing the vent through rotational manipulation of the vent cover 34 using the grip feature 44. While a 180° rotation between open and closed conditions is preferred, other rotation angles can also be used. Similarly, the detent can be locked, for example, on the periphery of the cover 34, rather than on the bottom.

What is claimed:

1. A closure for containers of pourable liquid comprising:

a deck, a pour spout coupled to said deck, and a vent structure coupled to said deck and offset from the pour spout, the vent structure including:

an imperforate area coupled to said deck and being formed without any pre-formed holes extending from an upper surface of said imperforate area to a lower surface of said imperforate area, said imperforate area including (i) an integrally molded retainer structure coupled to the upper surface of said imperforate area and, radially offset from said retainer structure, (ii) a recessed punch-out area spaced apart from the retainer structure and bounded by a frangible border, the recessed punch-out area being configured to provide a vent opening when at least partially separated from said imperforate area; and a vent cover having a vent hole that overlies said punch-out area when said vent cover is rotated to a first predetermined angular position; said vent cover having formed on a bottom surface thereof a bearing structure that snaps into said retainer structure for retaining said cover on said deck and allowing rotation of said cover to a second angular position wherein said punch-out area is fully closed by said vent cover, wherein the entire bearing structure is located above said upper surface of said imperforate area after being installed on said retainer structure.

2. The closure of claim 1, wherein the retainer structure and said bearing structure are molded with an undercut to provide a mutual snap fit relationship.

3. The closure of claim 1, wherein the cover has formed on the bottom surface a detent that fits into said recessed punch-out area when the vent cover is in the second angular position.

4. The closure of claim 1, wherein the first and second angular positions are 180° apart.

5. The closure of claim 1, wherein said punch-out area is provided with a partial frangible border wherein the punch-out area is configured to be separated from said deck structure to provide a vent opening without fully separating the punch-out area from said deck structure.

6. The closure of claim 5, further including a manual operable rib grip formed in a top surface of said vent cover and extending partially diametrically across said top surface.

7. The closure of claim 6, further including a structural feature molded into said deck adjacent said circular area with which the manually operable rib can be aligned in one of said first and second angular positions.

8. The closure of claim 1, further including indicia molded into said deck structure adjacent said generally circular imperforate area to provide operational instruction to a user of said vent structure.

9. The closure of claim 1, wherein the retainer structure includes a plurality of upright elements arranged in spaced-apart circumferential relationship to one another around a rotation axis of the vent cover such that the retainer structure is segmented.

10. The closure of claim 1, wherein said imperforate area includes an outer ring coupled to the deck and extending radially inwardly toward a central rotation axis of the vent cover and an inner disk coupled to an inner edge of the outer ring, and wherein said recessed punch-out area is coupled to said outer ring.

11. The closure of claim 10, wherein said retainer structure is coupled to said inner disk and said central rotation axis passes through said inner disk.

12. The closure of claim 11, wherein said retainer structure has a height from said upper surface of said imperforate area to a distal end of said retainer structure and said distal end is aligned with said upper surface on said outer ring.

13. The closure of claim 1, wherein the cover has formed on the bottom surface a detent that fits into said recessed punch-out area when the vent cover is in the second angular position, wherein the generally circular imperforate area further includes a secondary detent structure and the bottom surface of the vent cover is formed to include a first notch, wherein the secondary detent structure extends into the first notch when the vent cover is in the first predetermined angular position, and wherein the bottom surface of the vent cover is further formed to include a second notch opposite the first notch and the secondary detent structure extends into the second notch when the vent cover is in the second angular position.

14. The closure of claim 1, wherein the imperforate area is generally circular and surrounded by a circular rim that extends upwardly from the deck and the vent cover is at least partially received in an interior space defined by the circular rim.

15. The closure of claim 14, wherein the cover has formed on the bottom surface a detent that fits into said recessed punch-out area when the vent cover is in the second angular position, the generally circular imperforate area includes a secondary detent structure, and the bottom surface of the vent cover is formed to include a first notch that extends into the first notch when the vent cover is in the first predetermined angular position, and wherein the bottom surface of the vent cover is further formed to include a second notch opposite the first notch and the secondary detent structure extends into the second notch when the vent cover is in the second angular position.

16. A closure for a container comprising:

a deck, a spout coupled to said deck, and a vent structure coupled to said deck and offset from the spout, the vent structure including:

an imperforate area integral with said deck and being formed without any pre-formed holes extending therethrough, an integrally molded retainer structure coupled to an upper surface of said imperforate area, a punch-out area with a frangible border coupled to said imperforate area and positioned radially offset from said retainer structure, wherein said punch-out area provides a vent opening in said imperforate area when said punch-out area is at least partially separated from said imperforate area; and a vent cover having a vent hole that overlies said punch-out area when said vent cover is rotated to a first predetermined angular position; said vent cover having formed on a bottom surface thereof a bearing structure that snaps into said retainer structure for retaining said cover on said deck and allowing rotation of said cover to a second angular position wherein said punch-out area is fully closed by said vent cover.

17. The closure of claim 16, wherein a lower edge of said bearing structure is located above said upper surface of said imperforate area after being installed on said retainer structure.

18. The closure of claim 17, wherein said imperforate area includes an outer ring coupled to the deck and extending radially inwardly toward a central rotation axis of the vent cover and an inner disk coupled to an inner edge of the outer ring, and wherein said punch-out area is coupled to said outer ring.

19. The closure of claim 18, wherein said retainer structure is coupled to said inner disk and said central rotation axis passes through said inner disk.

20. The closure of claim 19, wherein said retainer structure has a height from said upper surface of said imperforate area to a distal end of said retainer structure and said distal end is aligned with said upper surface on said outer ring.

* * * * *